US008841826B2

(12) United States Patent
Kasuya et al.

(10) Patent No.: US 8,841,826 B2
(45) Date of Patent: Sep. 23, 2014

(54) SPARK PLUG

(75) Inventors: Yuji Kasuya, Nagoya (JP); Kenji Ban, Gifu (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 112 days.

(21) Appl. No.: 13/578,175

(22) PCT Filed: Nov. 26, 2010

(86) PCT No.: PCT/JP2010/006898
§ 371 (c)(1),
(2), (4) Date: Aug. 9, 2012

(87) PCT Pub. No.: WO2011/101939
PCT Pub. Date: Aug. 25, 2011

(65) Prior Publication Data

US 2012/0313503 A1 Dec. 13, 2012

(30) Foreign Application Priority Data

Feb. 18, 2010 (JP) ..... 2010-033548

(51) Int. Cl.
*H01T 13/20* (2006.01)
*H01T 13/39* (2006.01)
*F02P 13/00* (2006.01)

(52) U.S. Cl.
CPC ..... *H01T 13/39* (2013.01); *F02P 13/00* (2013.01)
USPC ..... 313/141; 313/142; 313/143

(58) Field of Classification Search
CPC ..... F02P 13/00
USPC ..... 313/118, 141–145
See application file for complete search history.

(56) References Cited

U.S. PATENT DOCUMENTS 6,215,235 B1 4/2001 Osamura
6,528,929 B1 3/2003 Matsutani et al.

(Continued)

FOREIGN PATENT DOCUMENTS

EP 1276189 A 1/2003
EP 2073328 A 6/2009

(Continued)

OTHER PUBLICATIONS

European Search Report mailed Nov. 4, 2013 for the corresponding European Patent Application No. 10846079.1.

(Continued)

*Primary Examiner* — Elmito Breval
(74) *Attorney, Agent, or Firm* — Leason Ellis LLP.

(57) ABSTRACT

A spark plug includes a ceramic insulator, a center electrode, a metallic shell, and a ground electrode. The center electrode has a shoulder portion at a forward end portion, which tapers forward with respect to the axial direction. A noble metal tip is joined to the forward end portion of the center electrode through a fusion zone. A spark discharge gap is formed between the noble metal tip and the ground electrode. The shortest distance between the fusion zone and a forward end surface of the noble metal tip is 0.8-1.2 mm. The outside diameter of the fusion zone as measured at a forward end of the fusion zone is smaller than that as measured at a rear end of the fusion zone. An acute angle θ1 formed by a straight line L1 and a straight line L2 satisfies the relational expression θ1≤72°.

16 Claims, 9 Drawing Sheets

(56) References Cited

U.S. PATENT DOCUMENTS

| | | | | |
|---|---|---|---|---|
| 6,707,237 | B2 | 3/2004 | Teramura et al. | |
| 7,821,186 | B2 | 10/2010 | Kameda et al. | |
| 2002/0149307 | A1 | 10/2002 | Klett et al. | |
| 2003/0071552 | A1 | 4/2003 | Teramura et al. | |
| 2004/0115976 | A1 | 6/2004 | Morita et al. | |
| 2005/0057133 | A1 | 3/2005 | Hori | |
| 2009/0127997 | A1* | 5/2009 | Kameda et al. | 313/141 |
| 2009/0134764 | A1* | 5/2009 | Kameda et al. | 313/141 |
| 2009/0160305 | A1 | 6/2009 | Kameda et al. | |
| 2010/0264804 | A1 | 10/2010 | Kameda et al. | |
| 2010/0275870 | A1* | 11/2010 | Kameda et al. | 123/169 EL |

FOREIGN PATENT DOCUMENTS

| | | | |
|---|---|---|---|
| FR | 2310643 | A | 12/1976 |
| GB | 1497641 | A | 1/1978 |
| JP | 64-007491 | | 1/1989 |
| JP | 11-233233 | | 8/1999 |
| JP | 2000-208235 | | 7/2000 |
| JP | 2001-060488 | | 3/2001 |
| JP | 2004-500690 | | 1/2004 |
| JP | 2004-207219 | | 7/2004 |
| JP | 2005-093221 | | 4/2005 |
| JP | 2009-158343 | | 7/2009 |
| JP | 2009-187840 | | 8/2009 |

OTHER PUBLICATIONS

International Search Report mailed Feb. 8, 2011, for the corresponding PCT Application No. PCT/JP2010/006898.

* cited by examiner

SPARK PLUG

CROSS-REFERENCE TO RELATED PATENT APPLICATIONS

This application is a U.S. National Phase Application under 35 U.S.C. §371 of International Patent Application No. PCT/JP2010/006898, filed Nov. 26, 2010, and claims the benefit of Japanese Patent Application No. 2010-033548, filed Feb. 18, 2010, all of which are incorporated by reference herein. The International Application was published in Japanese on Aug. 25, 2011 as International Publication No. WO/2011/101939 under PCT Article 21(2).

FIELD OF THE INVENTION

The present invention relates to a spark plug for use in an internal combustion engine or the like.

BACKGROUND OF THE INVENTION

A spark plug for use in a combustion apparatus, such as an internal combustion engine, includes, for example, a center electrode extending in the axial direction, an insulator provided externally of the outer circumference of the center electrode, a cylindrical metallic shell mounted to the outside of the insulator, and a ground electrode extending from a forward end portion of the metallic shell and bent toward the center electrode. Also, in order to improve ignition performance and erosion resistance, there is proposed a technique for joining a noble metal tip formed of a noble metal alloy to a forward end portion of the center electrode.

Furthermore, in recent years, elongating the noble metal tip along the axial direction has been proposed (refer to, for example, Japanese Patent Application Laid-Open (kokai) No. 2009-158343). Such proposition has been made for, for example, the following reason.

In a spark plug of such a type that the forward (or distal) end surface of a ground electrode faces the side surface of a distal end portion of a noble metal tip to thereby generate spark discharges across a spark discharge gap between the two members substantially along a direction orthogonal to the axis (a so-called lateral discharge type), if the ground electrode and a fusion zone of joining a center electrode and the noble metal tip are close to each other, an abnormal spark discharge may be generated between the fusion zone and the ground electrode, potentially resulting in a deterioration in durability. In this regard, by means of the noble metal tip being elongated, a sufficient distance along the axial direction can be secured between the fusion zone and the ground electrode, whereby there can be more reliably prevented the generation of an abnormal spark discharge and, in turn, a deterioration in durability.

Also, in a spark plug of such a type that a distal end portion of a ground electrode faces the distal end surface of a noble metal tip to thereby generate spark discharges across a spark discharge gap between the two members substantially along the axial direction (a so-called parallel electrode type), by means of the noble metal tip being elongated, the position of ignition can be projected closer to the center of a combustion chamber, whereby ignition performance can be improved. That is, in view of improvement of durability and ignition performance, various types of spark plugs could employ elongation of the noble metal tip along the axial direction.

Problems to be Solved by the Invention

However, the elongation of the noble metal tip involves the following problem. Vibration associated with operation of an internal combustion engine or the like applies a greater stress to a region in a center electrode located in the vicinity of a rear (or proximal) end portion of a noble metal tip and to a boundary region between the center electrode and a fusion zone. This may cause breakage at the center electrode, the boundary region, etc., resulting in a failure to sufficiently exhibit the above-mentioned actions and effects associated with provision of the noble metal tip.

The present invention has been conceived in view of the above circumstances, and an object of the invention is to provide a spark plug which has a relatively long noble metal tip and which can more reliably prevent breakage of a center electrode, etc., and, eventually, can sufficiently exhibit the effect of improving ignition performance, durability, etc., associated with provision of a noble metal tip.

SUMMARY OF THE INVENTION

Means for Solving the Problems

Configurations suitable for achieving the above object will next be described in itemized form. If needed, actions and effects peculiar to the configurations will be described additionally.

Configuration 1: A spark plug of the present configuration comprises a tubular insulator having an axial bore extending through the insulator in a direction of an axis; a center electrode inserted into a forward end portion of the axial bore; a tubular metallic shell provided externally of an outer circumference of the insulator; a ground electrode disposed at a forward end portion of the metallic shell; and a noble metal tip joined to a forward end portion of the center electrode and forming a gap in cooperation with the ground electrode; the center electrode having a shoulder portion at a forward end portion of the center electrode, the shoulder portion tapering forward with respect to the direction of the axis, the noble metal tip being jointed to the center electrode by means of a fusion zone being formed at least partially at a proximal end portion of the noble metal tip through laser-welding-effected fusion of the noble metal tip and the center electrode, and a shortest distance between the fusion zone and a distal end surface of the noble metal tip being 0.8 mm to 1.2 mm inclusive as measured on an outer side surface of the noble metal tip along the axis. The spark plug is characterized in that an outside diameter of the fusion zone as measured at a distal end of the fusion zone is smaller than that as measured at a proximal end of the fusion zone, and with $\theta 1$ representing an acute angle formed by a straight line L1 and a straight line L2 defined below, a relational expression $\theta 1 \leq 72°$ is satisfied.

The straight line L1 is, as viewed on a section which contains the axis, an axially forward extended straight line of one of two outlines of the shoulder portion, the two outlines being located on opposite sides with respect to the axis. The straight line L2 is, as viewed on the section which contains the axis, an axially forward extended straight line of the other of the two outlines of the shoulder portion, the two outlines being located on opposite sides with respect to the axis. As viewed on the section which contains the axis, the outlines of the shoulder portion may be curved or bent. In the case where the outlines of the shoulder portion are curved, each of the straight lines L1 and L2 is an axially forward extended straight line of a line segment that connects opposite ends of each of the outlines. In the case where the outlines of the shoulder portion are bent, each of the straight lines L1 and L2 is an axially forward extended straight line of a line segment located forward of a bend in each of the outlines of the shoulder portion.

When the shortest distance between the fusion zone and the distal end surface of the noble metal tip as measured along the axis is greater than 1.2 mm, stress imposed on the shoulder portion, etc., increases excessively, and heat transfer from the noble metal tip deteriorates. Therefore, preferably, in order to prevent breakage at the shoulder portion, etc., and deterioration in erosion resistance of the noble metal tip, the shortest distance is 1.2 mm or less.

Also, in view of further improvement of breakage resistance, preferably, the angle θ1 is further reduced. However, when the angle θ1 is reduced, the axial length of the shoulder portion increases. Accordingly, the noble metal tip is disposed in such a manner as to excessively project forward relative to the forward end of the insulator. As a result, heat resistance, etc., may deteriorate. Meanwhile, when the amount of projection of the noble metal tip relative to the forward end of the insulator is restrained, a large annular space is formed between the outer circumference of a proximal end subportion of the shoulder portion and the wall of the axial bore of the insulator; accordingly, heat resistance of the insulator may deteriorate. Therefore, in the case where the angle θ1 is relatively small, preferably, in order to prevent excessive increase of the axial length of the shoulder portion, the rear end of the shoulder portion has a relatively small outside diameter (e.g., 2.6 mm or less or 2.1 mm or less).

Configuration 2: A spark plug of the present configuration is characterized in that, in the above configuration 1, with θ2 representing an acute angle formed by a straight line L3 and a straight line L4 defined below, as viewed on a section which contains the axis and on which θ2 is maximized, relational expressions $\theta 1 > \theta 2$ and $(\theta 1 - \theta 2) \leq 50°$ are satisfied.

The straight line L3 is, as viewed on the section which contains the axis, a straight line which passes through opposite ends of one of two outlines of an externally exposed surface of the fusion zone, the one outline being located on one side with respect to the axis. The straight line L4 is, as viewed on the section which contains the axis, a straight line which passes through opposite ends of the other of the two outlines of the externally exposed surface of the fusion zone, the other outline being located on the other side with respect to the axis.

Configuration 3: A spark plug of the present configuration is characterized in that, in the above configuration 1 or 2, as viewed on the section which contains the axis, the outlines of the shoulder portion are rectilinear.

The term "rectilinear" means that the outlines of the shoulder portion are neither bent (i.e., not angular) nor excessively curved, and does not mean that the outlines of the shoulder portion are straight lines in a strict sense.

Configuration 4: A spark plug of the present configuration is characterized in that: in any one of the above configurations 1 to 3, the center electrode comprises an outer layer and an inner layer provided within the outer layer and being higher in thermal conductivity than the outer layer; a distance from the inner layer to a proximal end surface of the noble metal tip or a distance from the inner layer to the fusion zone, whichever is shorter, is 2 mm or less; and with θ3 representing, as viewed on the section which contains the axis, an acute angle formed by two straight lines which pass through an intersection point of the straight lines L1 and L2 and which are tangent to an outline of the inner layer, a relational expression $(\theta 1 \times 1/3) \leq \theta 3$ is satisfied.

Configuration 5: A spark plug of the present configuration is characterized in that, in the above configuration 4, a relational expression $\theta 3 \leq (\theta 1 \times 3/4)$ is satisfied.

Configuration 6: A spark plug of the present configuration is characterized in that, in any one of the above configurations 1 to 5, the ground electrode is disposed in such a manner that a distal end surface of the ground electrode faces an outer side surface of the noble metal tip, and spark discharge is performed across the gap substantially along a direction orthogonal to the axis.

Configuration 7: A spark plug of the present configuration is characterized in that, in any one of the above configurations 1 to 6, the noble metal tip assumes the form of a circular column, and a distal end surface of the noble metal tip has an outside diameter of 0.7 mm or less.

Configuration 8: A spark plug of the present configuration is characterized in that, in any one of the above configurations 1 to 7, the noble metal tip assumes the form of a circular column, and a distal end surface of the noble metal tip has an outside diameter of 0.5 mm or less.

Configuration 9: A spark plug of the present configuration is characterized in that, in any one of the above configurations 1 to 8, the noble metal tip is formed of an alloy which contains iridium (Ir) or platinum (Pt) as a main component.

Effects of the Invention

According to the spark plug of configuration 1, the noble metal tip is relatively elongated such that the shortest distance between the fusion zone and the distal end surface of the noble metal tip is 0.8 mm or greater as measured on the outer side surface of the noble metal tip. Therefore, durability and ignition performance can be improved.

Meanwhile, when the noble metal tip is relatively elongated, as mentioned above, breakage at the center electrode, etc., is a concern. However, according to the above configuration 1, the acute angle θ1 formed by the straight lines L1 and L2 assumes a relatively small value of 72° or less. That is, in view that stress concentrates where cross-sectional area changes to a relatively great extent, configuration is determined such that the rate of change in cross-sectional area along the axis is relatively low at the shoulder portion of the center electrode, breakage at the shoulder portion being a particular concern. Therefore, the concentration of stress associated with vibration on the shoulder portion can be effectively restrained, whereby breakage at the shoulder portion can be reliably prevented.

Also, the fusion zone formed at a distal end subportion of the shoulder portion is configured such that the outside diameter of the fusion zone as measured at the distal end of the fusion zone is smaller than that as measured at the proximal end of the fusion zone (that is, the contour of the fusion zone is tapered). Therefore, a boundary region between the shoulder portion and the fusion zone can be prevented from having a steeply bent shape (a shape involving a sharp change in cross-sectional area), whereby stress associated with vibration can be more reliably prevented from concentrating on the boundary region or its vicinity. As a result, breakage at the boundary region and its vicinity can be more reliably restrained.

Thus, according to the spark plug of configuration 1, breakage resistance of the shoulder portion, the boundary region, etc., can be improved; eventually, the effect of improving durability and ignition performance associated with provision of the noble metal tip can be exhibited over a long period of time.

According to the spark plug of configuration 2, the angle θ2 formed by the straight line L3 and the straight line L4 is determined so as to satisfy the relational expression $\theta 1 - \theta 2 \leq 50°$. Therefore, in a region ranging from the shoulder portion to the fusion zone, the rate of change in cross-sectional area along the direction of the axis can be further reduced; eventually, stress concentration on the shoulder portion and the fusion zone can be further reliably prevented. As a result, breakage resistance can be further improved.

According to the spark plug of configuration 3, the outlines of the shoulder portion are rectilinear; thus, stress concentration on the shoulder portion can be further reliably prevented. As a result, breakage resistance can be further improved.

Heat of the noble metal tip is transferred toward the center electrode directly from the noble metal tip or via the fusion zone. According to the spark plug of configuration 4, at least one of the distance from the inner layer provided within the center electrode and having excellent thermal conductivity to the proximal end surface of the noble metal tip and the distance from the inner layer to the fusion zone is 2 mm or less (that is, the inner layer is disposed relatively close to the noble metal tip and the fusion zone). Additionally, configuration is determined such that the relational expression $\theta 1 \times 1/3 \leq \theta 3$ is satisfied; i.e., such that a forward end portion of the inner layer has a sufficient volume corresponding to the diametral size of a forward end portion of the center electrode, the diametral size varying with the angle θ1. Thus, the inner layer allows efficient transfer of heat thereto from the noble metal tip, whereby erosion resistance of the noble metal tip can be further improved.

As in the case of the spark plug of configuration 4, through employment of a relatively large angle θ3, erosion resistance of the noble metal tip can be improved. However, when the angle θ3 is excessively large, as viewed on a section of a forward end portion of the center electrode taken orthogonally to the axis, the inner layer accounts for an excessively large area, whereas the outer layer is excessively thin-walled. As a result, the amount of thermal expansion of the inner layer increases, and the strength of the outer layer becomes insufficient. Eventually, exposure to repeated heating/cooling cycles may cause cracking in the surface of the center electrode.

In this regard, according to the spark plug of configuration 5, since the relational expression $\theta 3 \leq (\theta 1 \times 3/4)$ is satisfied, there are provided the inner layer having an appropriate volume corresponding to the diametral size of a forward end portion of the center electrode, the diametral size varying with the angle θ1, and the outer layer having an appropriate thickness. As a result, the outer layer has sufficient strength against thermal expansion of the inner layer, whereby the generation of cracking in the center electrode can be more reliably prevented.

As in the case of the spark plug of configuration 6, in a spark plug of such a type that spark discharge is performed substantially along a direction orthogonal to the axis (a so-called lateral discharge type), in order to prevent an abnormal spark discharge between the fusion zone and the ground electrode, further elongation of the noble metal tip is desired. However, further elongation of the noble metal tip increases the risk of breakage at the center electrode, etc.

In this regard, through employment of the above configuration 1, etc., in a spark plug of a lateral discharge type, which requires further elongation of the noble metal tip, breakage of the center electrode, etc., can be more reliably prevented. That is, the above configuration 1, etc., are particularly significant for a spark plug of a lateral discharge type.

In order to restrain a flame-extinguishing action exerted by the noble metal tip for improvement of ignition performance, preferably, the noble metal tip has a relatively small diameter. However, when the noble metal tip is reduced in diameter, the shoulder portion to which the noble metal tip is joined also has a relatively small diameter. When the shoulder portion is reduced in diameter, strength of the shoulder portion deteriorates. Accordingly, breakage at the shoulder portion, etc., is a further concern.

In this regard, according to the spark plug of configuration 7, since the noble metal tip is reduced in diameter such that the distal end surface of the noble metal tip has an outside diameter of 0.7 mm or less, improvement in ignition performance can be expected, whereas deterioration in breakage resistance is a concern. However, the concern can be eradicated through employment of the above configuration 1, etc. In other words, the above configuration 1, etc., are particularly effective for a spark plug having a noble metal tip which is reduced in diameter such that the distal end surface of the noble metal tip has an outside diameter of 0.7 mm or less.

According to the spark plug of configuration 8, since the noble metal tip is further reduced in diameter such that the distal end surface of the noble metal tip has an outside diameter of 0.5 mm or less, further improvement in ignition performance can be expected, whereas deterioration in breakage resistance is a further concern. In this regard, through employment of the above configuration 1, etc., stress concentration on the shoulder portion can be restrained; thus, while good ignition performance is maintained, excellent breakage resistance can be achieved. In other words, the above configuration 1, etc., are further effective for a spark plug having a noble metal tip which is reduced in diameter such that the distal end surface of the noble metal tip has an outside diameter of 0.5 mm or less.

According to the spark plug of configuration 9, since the noble metal tip is formed of an alloy which contains Pt or Ir as a main component and thus has excellent erosion resistance, durability can be further improved.

Also, through use of such an alloy, a slender noble metal tip as in the case of the above configurations 7 and 8 can be formed with relative ease.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying Out the Invention

Figure 1:
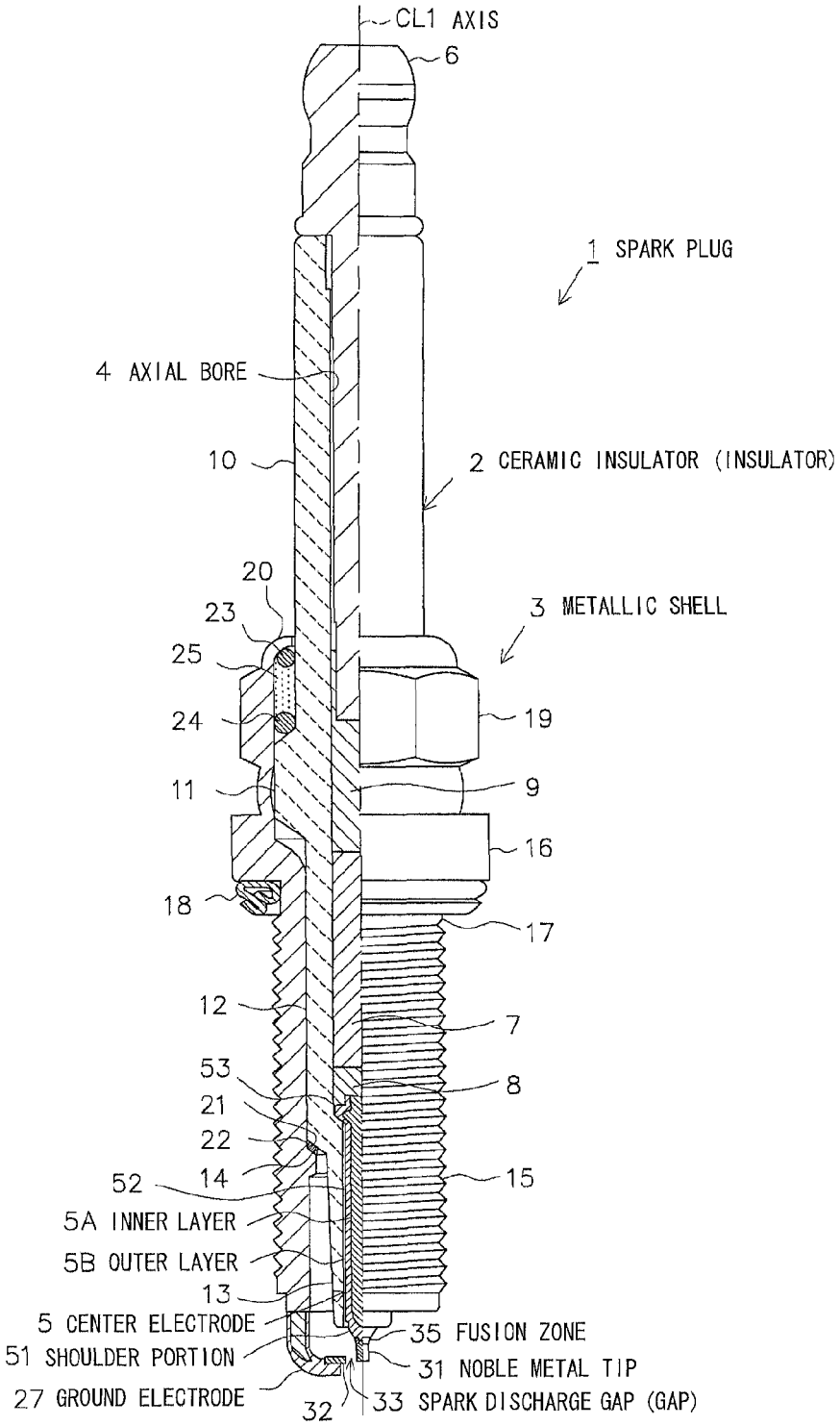
FIG. 1 is a partially cutaway front view showing the configuration of a spark plug.

An embodiment of the present invention will next be described with reference to the drawings. FIG. 1 is a partially cutaway front view showing a spark plug 1. In FIG. 1, the direction of an axis CL1 of the spark plug 1 is referred to as the vertical direction. In the following description, the lower side of the spark plug 1 in FIG. 1 is referred to as the forward side of the spark plug 1, and the upper side as the rear side.

The spark plug 1 includes a ceramic insulator 2, which is the insulator in the present invention, and a tubular metallic shell 3 which holds the ceramic insulator 2 therein.

The ceramic insulator 2 is formed from alumina or the like by firing, as well known in the art. The ceramic insulator 2, as viewed externally, includes a rear trunk portion 10 formed on the rear side; a large-diameter portion 11, which is located forward of the rear trunk portion 10 and projects radially outward; an intermediate trunk portion 12, which is located forward of the large-diameter portion 11 and is smaller in diameter than the large-diameter portion 11; and a leg portion 13, which is located forward of the intermediate trunk portion 12 and is smaller in diameter than the intermediate trunk portion 12. Additionally, the large-diameter portion 11, the intermediate trunk portion 12, and most of the leg portion 13 are accommodated within the metallic shell 3. Also, a tapered, stepped portion 14 is formed at a transitional portion between the intermediate trunk portion 12 and the leg portion 13. The ceramic insulator 2 is seated on the metallic shell 3 at the stepped portion 14.

Furthermore, the ceramic insulator 2 has an axial bore 4 extending therethrough along the axis CL1. A center electrode 5 is fixedly inserted into a forward end portion of the axial bore 4. The center electrode 5 includes, sequentially from the forward side, a shoulder portion 51 tapering forward with respect to the direction of the axis CL1; a body portion 52 extending from the rear end of the shoulder portion 51 along the axis CL1; and a flange portion 53 expanding radially outward at the rear end of the body portion 52. The flange portion 53 is seated on a taper portion of the axial bore 4. In the present embodiment, the body portion 52 is reduced in diameter such that a proximal end subportion of the body portion 52 has a relatively small outside diameter (e.g., 2.6 mm or less, or 2.1 mm or less). Also, the body portion 52 has, at its distal end, a small-diameter portion 52A (see FIG. 2) called a thermo-portion and having the substantially same outer shape.

Additionally, the center electrode 5 has an outer layer 5B formed of an Ni alloy which contains nickel (Ni) as a main component, and an inner layer 5A formed of a metal material (e.g., copper, a copper alloy, or pure Ni) higher in thermal conductivity than the outer layer 5B. The center electrode 5 is disposed such that its forward end portion projects from the forward end of the ceramic insulator 2. A noble metal tip 31 is joined to the forward end portion of the center electrode 5 via a fusion zone 35 formed by laser welding.

The noble metal tip 31 assumes the form of a circular column and is formed of an alloy which contains iridium (Ir) or platinum (Pt) as a main component. Also, the fusion zone 35 is formed through fusion of a metal used to form the center electrode 5 and a metal used to form the noble metal tip 31 and is formed at least partially at a proximal end portion of the noble metal tip 31 (the configuration of the center electrode 5, the noble metal tip 31, and the fusion zone 35 will be described later in detail).

A terminal electrode 6 formed of a low-carbon steel or a like metal is fixedly inserted into the axial bore 4 from the rear side of the axial bore 4 in such a manner as to project from the rear end of the ceramic insulator 2.

Furthermore, a circular columnar resistor 7 is disposed within the axial bore 4 between the center electrode 5 and the terminal electrode 6. Opposite end portions of the resistor 7 are electrically connected to the center electrode 5 and the terminal electrode 6 via electrically conductive glass seal layers 8 and 9, respectively.

Additionally, the metallic shell 3 is formed into a tubular shape from a low-carbon steel or a like metal. The metallic shell 3 has a threaded portion (externally threaded portion) 15 on its outer circumferential surface. The threaded portion 15 is adapted to mount the spark plug 1 to a combustion apparatus, such as an internal combustion engine or a fuel cell reformer. Also, the metallic shell 3 has a seat portion 16 formed on its outer circumferential surface and located rearward of the threaded portion 15. A ring-like gasket 18 is fitted to a screw neck 17 located at the rear end of the threaded portion 15. Furthermore, the metallic shell 3 has a tool engagement portion 19 provided near its rear end. The tool engagement portion 19 has a hexagonal cross section and allows a tool such as a wrench to be engaged therewith when the spark plug 1 is to be mounted to the combustion apparatus. Also, the metallic shell 3 has a crimp portion 20 provided at its rear end portion and adapted to hold the ceramic insulator 2. In the present embodiment, in order to reduce the size of the spark plug 1, the metallic shell 3 is formed to have a relatively small diameter, and, in turn, the threaded portion 15 has a thread diameter of M12 or less (e.g., M10 or less).

Also, the metallic shell 3 has a tapered, stepped portion 21 provided on its inner circumferential surface and adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimp portion 20 is formed, whereby the ceramic insulator 2 is fixed in place. An annular sheet packing 22 intervenes between the stepped portions 14 and 21 of the ceramic insulator 2 and the metallic shell 3, respectively. This retains gastightness of a combustion chamber and prevents outward leakage of fuel gas that enters a clearance between the leg portion 13 of the ceramic insulator 2 and the inner circumferential surface of the metallic shell 3, which are exposed to the combustion chamber.

Furthermore, in order to ensure gastightness which is established by crimping, annular ring members 23 and 24 intervene between the metallic shell 3 and the ceramic insulator 2 in a region near the rear end of the metallic shell 3, and a space between the ring members 23 and 24 is filled with a powder of talc 25. That is, the metallic shell 3 holds the ceramic insulator 2 via the sheet packing 22, the ring members 23 and 24, and the talc 25.

Figure 2:
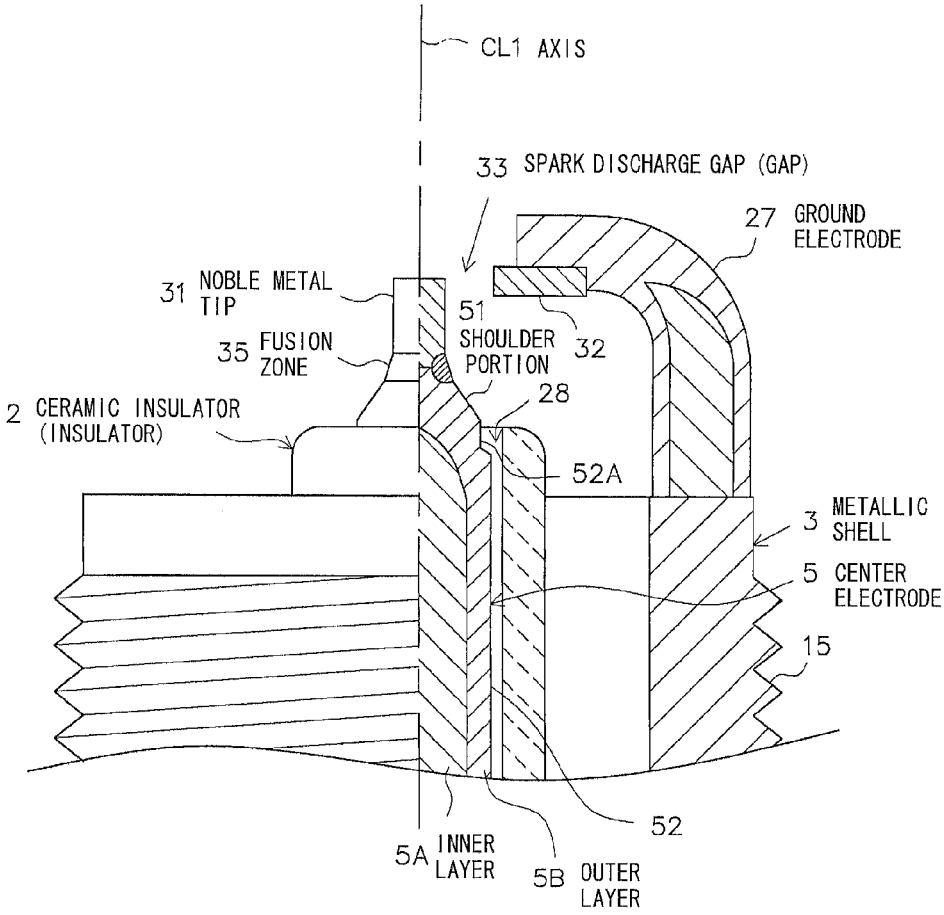
FIG. 2 is an enlarged partially cutaway front view showing the configuration of a forward end portion of the spark plug.

Also, as shown in FIG. 2, the ground electrode 27 is bent at its substantially middle portion such that its distal end surface faces the outer side surface of the noble metal tip 31, and is joined to a forward end portion of the metallic shell 3. Additionally, a rectangular columnar noble metal member 32 formed of a predetermined noble metal material (e.g., a Pt alloy or an Ir alloy) is jointed to the side surface of a distal end portion of the ground electrode 27 in such a manner as to protrude from both of the distal end surface and the side surface of the ground electrode 27. A spark discharge gap 33, which is the gap in the present invention, is formed between the noble metal member 32 and a distal end portion of the noble metal tip 31. Spark discharge is performed across the spark discharge gap 33 substantially along a direction orthogonal to the axis CL1.

Additionally, a thermo-pocket 28 is formed between the outer circumference of the ceramic insulator 2 and the wall surface of a forward end portion of the axial bore 4. The thermo-pocket 28 is an annular space about the axis CL1. By virtue of the thermo-pocket 28, the distance along the surface of the ceramic insulator 2 between the center electrode 5 and the metallic shell 3 and the distance between the center electrode 5 and the forward end of the ceramic insulator 2 can assume a relatively large value. Thus, an abnormal spark discharge which creeps on the surface of the ceramic insulator 2, such as so-called lateral sparks, can be more reliably prevented. The center electrode 5, etc., may be configured without provision of the small-diameter portion 52A and in turn without provision of the thermo-pocket 28.

Figure 3:
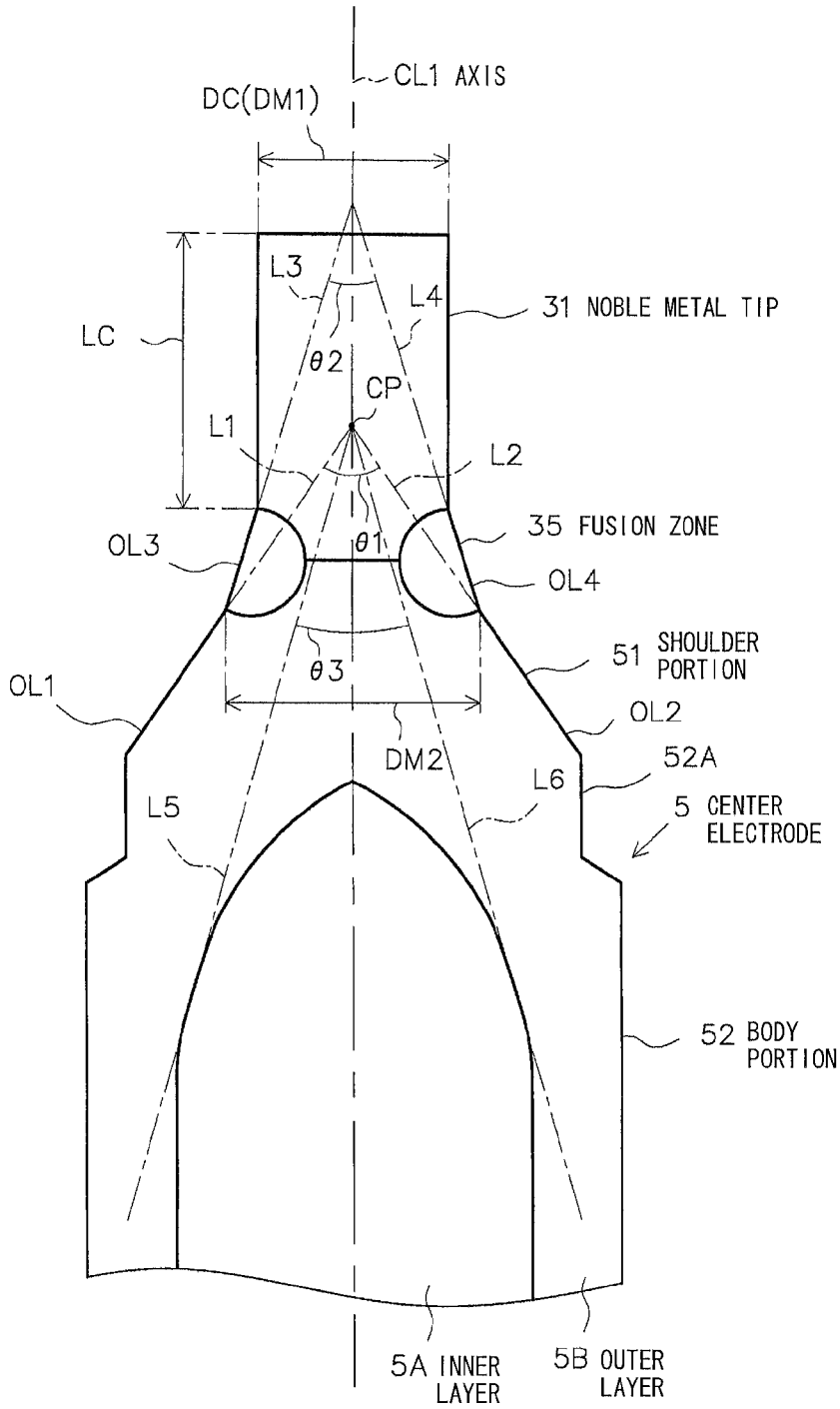
FIG. 3 is an enlarged schematic, fragmentary, sectional view showing the configuration of a shoulder portion, a fusion zone, etc.

Furthermore, in the present embodiment, while, in order to improve ignition performance, having a relatively small diameter, the noble metal tip 31 has a relatively long length along the axis CL1. Specifically, as shown in FIG. 3 (in FIG. 3, hatching generally employed in a sectional view is omitted for convenience of explanation), while having an outside diameter DC of 0.7 mm or less (e.g., 0.5 mm or less), the noble metal tip 31 has a shortest distance LC of 0.8 mm to 1.2 mm inclusive as measured on the outer side surface of the noble metal tip 31 along the axis CL1 between the fusion zone 35 and the distal end surface of the noble metal tip 31.

Also, the shoulder portion 51 of the center electrode 5 is tapered, and the distal end of the shoulder portion 51 is formed to have a relatively small diameter so as to correspond to the noble metal tip 31 having a relatively small diameter. Additionally, as viewed on a section which contains the axis CL1, the outlines OL1 and OL2 of the shoulder portion 51 are rectilinear (the shoulder portion 51 is a portion tapering forward with respect to the direction of the axis CL1, and the small-diameter portion 52A provided at the distal end of the body portion 52 and having the substantially same outer shape is not a constituent of the shoulder portion 51). The shoulder portion 51 is formed in such a manner as to satisfy a relational expression $\theta 1 \leq 72°$, wherein $\theta 1$ is an acute angle $\theta 1$ formed by a straight line L1 and a straight line L2; the straight line L1 is, as viewed on the section which contains the axis CL1, an axially forward extended straight line of the outline OL1 of the two outlines OL1 and OL2 of the shoulder portion 51, the two outlines OL1 and OL2 being located on opposite sides with respect to the axis CL1; and the straight line L2 is an axially forward extended straight line of the other outline OL2.

Figure 4:
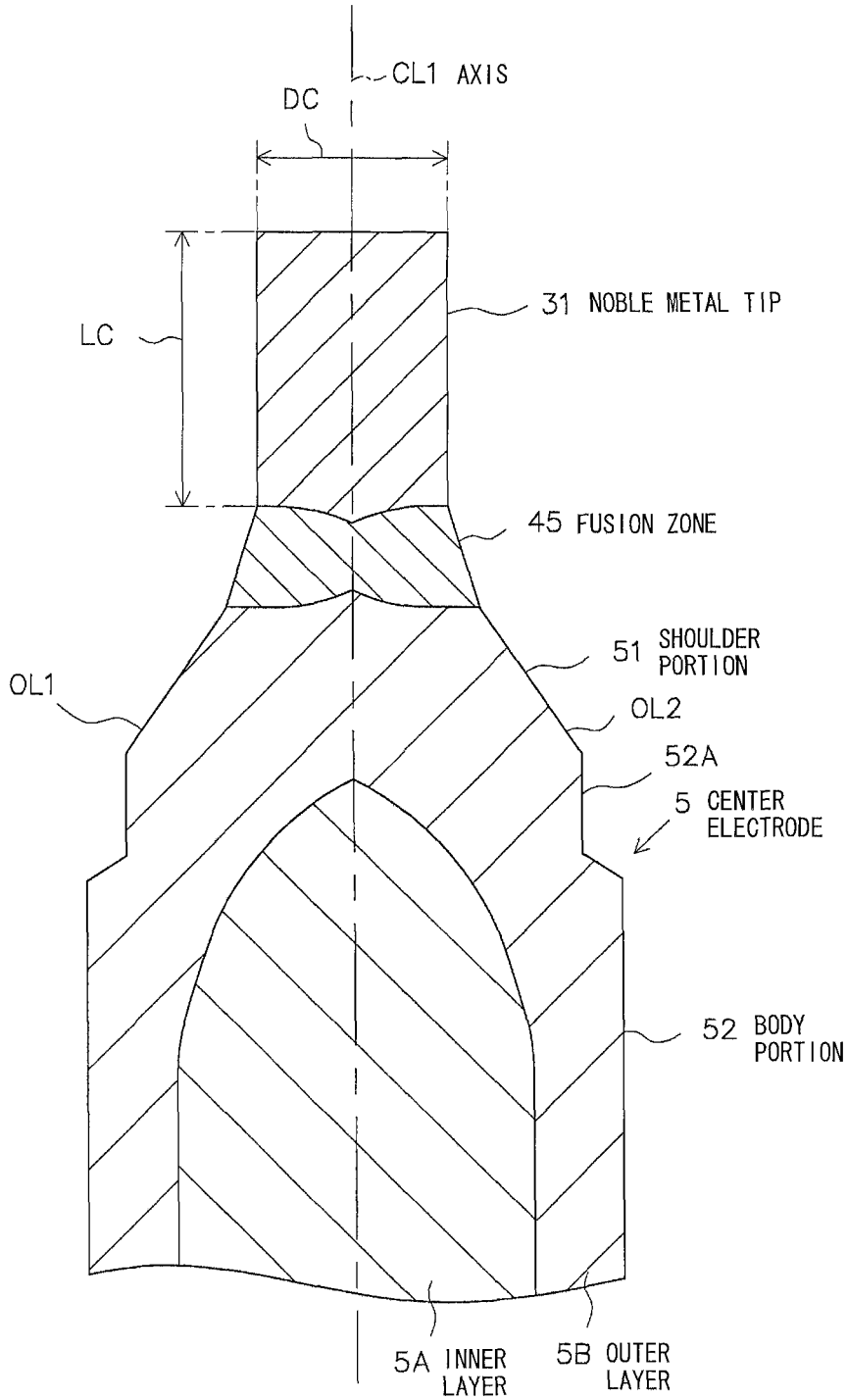
FIG. 4 is an enlarged fragmentary, sectional view showing the fusion zone, etc., for explaining another example of the fusion zone.

Additionally, the fusion zone 35 is annular about the axis CL1 such that on the axis CL1, the distal end surface of the center electrode 5 is in contact with the proximal end surface of the noble metal tip 31. The shape of the fusion zone 35 is not limited thereto. For example, as shown in FIG. 4, a fusion zone 45 may be formed over an entire region between the center electrode 5 and the noble metal tip 31 without involvement of contact between the distal end surface of the center electrode 5 and the proximal end surface of the noble metal tip 31.

Referring back to FIG. 3, the fusion zone 35 has such a shape that its outer circumferential portion tapers forward with respect to the direction of the axis CL1; i.e., an outside diameter DM1 of the fusion zone 35 as measured at the distal end of the fusion zone 35 is smaller than an outside diameter DM2 of the fusion zone 35 as measured at the proximal end of the fusion zone 35. Furthermore, the fusion zone 35, etc., are formed in such a manner as to satisfy relational expressions $\theta 1 > \theta 2$ and $(\theta 1 - \theta 2)$ 50°, wherein $\theta 2$ is an acute angle formed by a straight line L3 and a straight line L4; the straight line L3 is, as viewed on the section which contains the axis CL1, a straight line which passes through opposite ends of an outline OL3, one of two outlines OL3 and OL4 that are formed on an externally exposed surface of the fusion zone 35, the outline OL3 being located on one side with respect to the axis CL1; and the straight line L4 is a straight line which passes through opposite ends of the outline OL4 located on the other side with respect to the axis CL1.

In order to ensure sufficient joining strength of joining the noble metal tip 31 to the center electrode 5, the fusion zone 35 has a depth (as viewed on a section which contains the axis CL1, a distance from the outline OL3 or OL4 of the fusion zone 35 to an innermost position of the fusion zone 35 as measured along a direction orthogonal to the outline OL3 or OL4) of 0.2 mm or greater.

Furthermore, as mentioned above, the center electrode 5 has the inner layer 5A of excellent thermal conductivity provided therein. The inner layer 5A is designed to satisfy the following configuration. The inner layer 5A is provided such that the distance from the inner layer 5A to the proximal end surface of the noble metal tip 31 or to the fusion zone 35, whichever is shorter, is 2 mm or less, so as to be sufficiently close to the noble metal tip 31 and the fusion zone 35. Furthermore, the shape of the inner layer 5A is determined so as to satisfy the relational expression $(\theta 1 \times 1/3) \leq \theta 3 \leq (\theta 1 \times 3/4)$, wherein $\theta 3$ is, as viewed on a section which contains the axis CL1, an acute angle formed by two straight lines L5 and L6 which pass through an intersection point CP of the straight lines L1 and L2 and which are tangent to the outline of the inner layer 5A.

As described above in detail, according to the present embodiment, the noble metal tip 31 is such that the shortest distance LC between its distal end surface and the fusion zone 35 as measured along the axis CL1 is 0.8 mm or greater as measured on its outer side surface. Therefore, durability and ignition performance can be improved.

Meanwhile, when the noble metal tip 31 is relatively elongated, breakage at the center electrode 5, etc., is a concern. However, according to the present embodiment, the angle $\theta 1$ assumes a relatively small value of 72° or less. Therefore, the concentration of stress associated with vibration on the shoulder portion 51 can be effectively restrained, whereby breakage at the shoulder portion 51 can be reliably prevented.

Also, the fusion zone 35 is configured such that the outside diameter DM1 of the fusion zone 35 as measured at the distal end of the fusion zone 35 is smaller than the outside diameter DM2 of the fusion zone 35 as measured at the proximal end of the fusion zone 35. Therefore, a boundary region between the shoulder portion 51 and the fusion zone 35 can be prevented from having a steeply bent shape, whereby stress associated with vibration can be restrained from concentrating on the boundary region or its vicinity. As a result, breakage at the boundary region and its vicinity can be more reliably prevented.

Thus, according to the present embodiment, breakage resistance of the shoulder portion 51, the boundary region, etc., can be improved; eventually, the effect of improving durability and ignition performance associated with provision of the noble metal tip 31 can be exhibited over a long period of time.

Additionally, the angle θ2 formed by the straight line L3 and the straight line L4 is determined so as to satisfy the relational expression θ1−θ2≤50°. Therefore, in a region ranging from the shoulder portion 51 to the fusion zone 35, the rate of change in cross-sectional area along the direction of the axis can be further reduced; eventually, stress concentration on the shoulder portion 51 and the fusion zone 35 can be further reliably prevented. As a result, breakage resistance can be further improved.

Furthermore, the outlines OL1 and OL2 of the shoulder portion 51 are rectilinear; thus, stress concentration on the shoulder portion 51 can be further reliably prevented, and thus, breakage resistance can be further improved.

Furthermore, at least one of the distance from the inner layer 5A to the proximal end surface of the noble metal tip 31 and the distance from the inner layer 5A to the fusion zone 35 is 2 mm or less. Also, configuration is determined such that the relational expression (θ1×⅓)≤θ3 is satisfied (i.e., such that a forward end portion of the inner layer 5A has a sufficient volume corresponding to the diametral size of a forward end portion of the center electrode 5, the diametral size varying with the angle θ1). Thus, the inner layer 5A allows efficient transfer of heat thereto from the noble metal tip 31, whereby erosion resistance of the noble metal tip 31 can be further improved.

Meanwhile, the angle θ3 is determined so as to satisfy the relational expression θ3≤(≤1×¾); thus, there are provided the inner layer 5A having an appropriate volume corresponding to the diametral size of a forward end portion of the center electrode 5, the diametral size varying with the angle θ1, and the outer layer 5B having an appropriate thickness. As a result, the outer layer 5B has sufficient strength against thermal expansion of the inner layer 5A, whereby the generation of cracking in the center electrode 5 can be more reliably prevented.

Through employment of a relatively small angle θ1 of 72° or less, and a small diameter for the noble metal tip 31, the length of the shoulder portion 51 along the axis CL1 becomes relatively large. In view of heat resistance, etc., of the center electrode 5 and the noble metal tip 31, there is a limit to the degree of forward projection of a forward end portion (the noble metal tip 31) of the center electrode 5 with respect to the direction of the axis CL1; thus, in association with an increase in the length of the shoulder portion 51, the volume of the thermo-pocket 28 formed between the ceramic insulator 2 and the axial bore 4 increases. However, an excessive increase of the volume of the thermo-pocket 28 results in overheat of a forward end portion of the ceramic insulator 2, potentially resulting in the occurrence of preignition or a like problem. A conceivable measure to prevent overheat of the ceramic insulator 2 is, for example, a reduction in the length of the leg portion 13 of the ceramic insulator 2. In this case, since the surface area of the leg portion 13 reduces, fouling resistance may deteriorate. In this regard, according to the present embodiment, since the body portion 52 has a relatively small diameter, the length of the shoulder portion 51 along the direction of the axis CL1 can be rendered relatively short. Therefore, in spite of use of the noble metal tip 31 having a small diameter while an angle θ1 of 72° or less is employed, an excessive increase in the volume of the thermo-pocket 28 can be avoided. As a result, overheat of the ceramic insulator 2 can be restrained without need to reduce the length of the leg portion 13 (i.e., without involvement of deterioration in fouling resistance).

Figure 5:
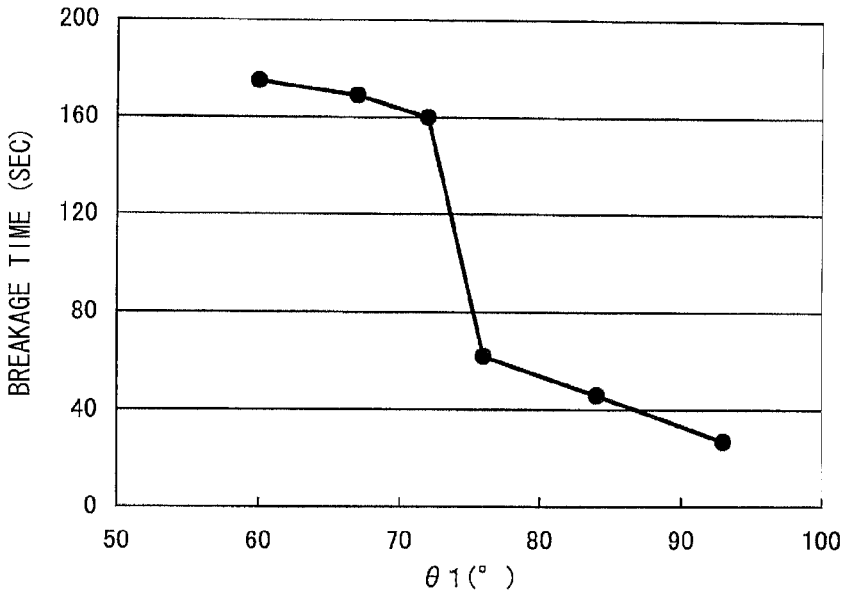
FIG. 5 is a graph showing the test results of a breakage resistance evaluation test on samples which differed in θ1.

Next, in order to verify actions and effects yielded by the above-described embodiment, there were manufactured spark plug samples which differed in the shortest distance (tip length) LC between the fusion zone and the distal end surface of the noble metal tip along the axis CL1 as effected through change of the noble metal tips and which differed in the magnitude of the angle θ1 formed by the straight line L1 and the straight line L2. The samples were subjected to a breakage resistance evaluation test. The outline of the breakage resistance evaluation test is as follows. Vibration of a frequency of 27.3 kHz was applied to the samples by means of an ultrasonic horn, and time until breakage occurred at the center electrode or the fusion zone (breakage time) was measured. The samples which exhibited a breakage time of 120 seconds or greater were evaluated as "Good," indicating that breakage resistance is good. The samples which exhibited a breakage time of 180 seconds or greater were evaluated as "Excellent," indicating that breakage resistance is excellent. By contrast, the samples which exhibited a breakage time of less than 120 seconds were evaluated as "Poor," indicating that breakage resistance is insufficient. Table 1 shows the results of the breakage resistance evaluation test. Notably, sample 10 had a shoulder portion whose outline was rectilinear, and the remaining samples had a shoulder portion whose outline includes a bend (an angular portion). Also, every sample had a fusion zone depth of 0.2 mm. Furthermore, FIG. 5 shows the test results of the samples (samples 6 to 9, 11, and 12) which differed only in the angle θ1 and were identical in other conditions, such as the tip length LC.

TABLE 1

| Sample No. | Tip length LC | θ1 | Breakage time | Evaluation |
|---|---|---|---|---|
| 1 | 0.7 mm | 105° | 166 sec | Good |
| 2 | | 93° | 183 sec | Excellent |
| 3 | | 84° | 205 sec | Excellent |
| 4 | 0.8 mm | 93° | 48 sec | Poor |
| 5 | | 72° | 160 sec or more | Good |
| 6 | 1.2 mm | 93° | 27 sec | Poor |
| 7 | | 84° | 46 sec | Poor |
| 8 | | 76° | 62 sec | Poor |
| 9 | | 72° | 160 sec | Good |
| 10 | | | 350 sec | Excellent |
| 11 | | 67° | 169 sec | Good |
| 12 | | 60° | 175 sec | Good |
| 13 | 1.4 mm | 72° | 43 sec | Poor |
| 14 | 1.6 mm | | 43 sec or less | Poor |
| 15 | 1.8 mm | | 43 sec or less | Poor |
| 16 | 2.1 mm | | 43 sec or less | Poor |
| 17 | 2.3 mm | | 43 sec or less | Poor |
| 18 | 2.5 mm | | 43 sec or less | Poor |

As shown in Table 1, the samples having a tip length LC of 0.7 mm (samples 1 to 3) exhibited excellent breakage resistance irrespective of the value of the angle θ1. On the other hand, the samples having a tip length LC of 0.8 mm or greater (samples 4 to −18) were found to potentially have insufficient breakage resistance.

When attention is focused on the samples having a tip length LC of 0.8 mm or greater, the samples having a tip length LC of 1.2 mm or less and an angle θ1 of 72° or less (samples 5 and 9 to 12) exhibit a breakage time of 120 seconds or greater, indicating that they have excellent breakage resistance. Conceivably, this is for the following reason: through employment of an angle θ1 of 72° or less, the rate of change along the axial direction in cross-sectional area of the shoulder portion is relatively low; eventually, stress concentration on the shoulder portion associated with vibration has been restrained. Also, as shown in FIG. 5, it has been confirmed that as the angle θ1 reduces, breakage resistance further improves.

Also, the following has been found: in contrast to the samples in which the outline of the shoulder portion includes a bend, the sample in which the outline of the shoulder portion is rectilinear to thereby be free of a bend (sample 10) has quite excellent breakage resistance. Conceivably, this is for the following reason: since cross-sectional area as measured along the axial direction changes somewhat abruptly at a bend, stress is apt to concentrate on the bend; thus, through elimination of the bend, stress concentration on the shoulder portion has been further restrained.

On the basis of the above test results, for a spark plug in which breakage at the center electrode, etc., is a further concern because of employment of a tip length of 0.8 mm to 1.2 mm inclusive, forming the shoulder portion having an angle θ1 of 72° or less is significant for improvement of breakage resistance.

Also, in view of further improvement of breakage resistance, it is significant for the shoulder portion to have a rectilinear outline and to further reduce the angle θ1 (e.g., 60° or less).

Figure 6:
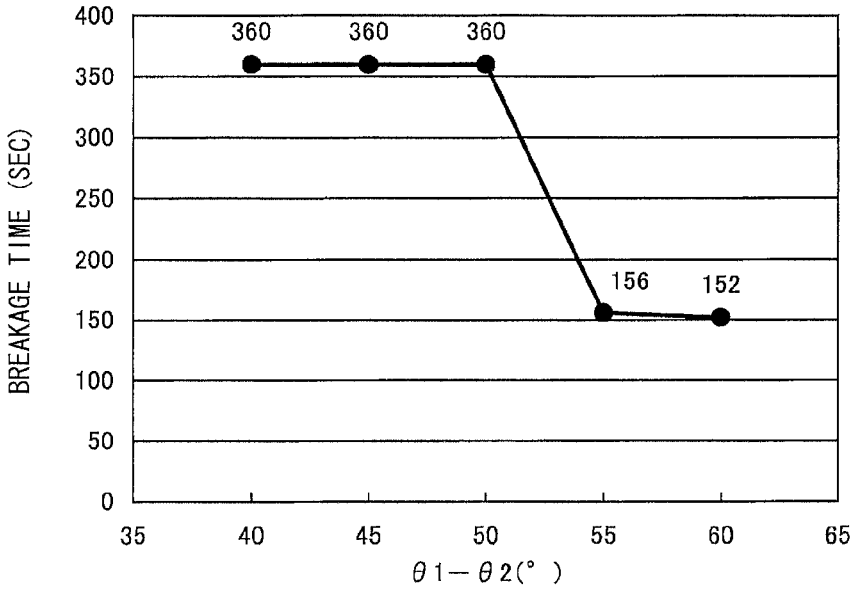
FIG. 6 is a graph showing the test results of the breakage resistance evaluation test on samples which had a θ1 of 72° and differed in θ1−θ2.
Figure 7:
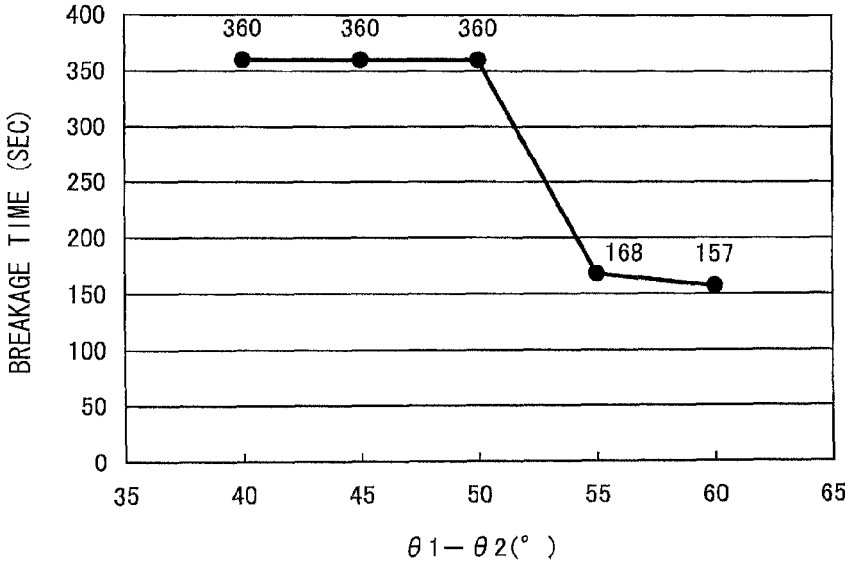
FIG. 7 is a graph showing the test results of the breakage resistance evaluation test on samples which had a θ1 of 60° and differed in θ1−θ2.

Next, there were manufactured spark plug samples which had a tip length LC of 1.2 mm and an angle θ1 of 72° or 60° and differed in the difference (θ1−θ2) between the angle θ1 and the angle θ2 formed by the straight line L3 and the straight line L4 as effected through change in the shape of the fusion zone. The samples were subjected to the above-mentioned breakage resistance evaluation test. FIG. 6 shows the test results of the samples having an angle θ1 of 72°. FIG. 7 shows the test results of the samples having an angle θ1 of 60°. FIGS. 6 and 7 indicate that the breakage time is 360 seconds, in the case where breakage did not occur at the center electrode and the fusion zone over a long period of time of 360 seconds or longer. Also, every sample had a fusion zone depth of 0.2 mm.

As shown in FIGS. 6 and 7, the samples exhibited a breakage time of 120 seconds or greater, indicating that they had good breakage resistance. Particularly, the samples having a difference (θ1−θ2) of 50° or less exhibited a breakage time of 360 seconds or greater, indicating that they had quite excellent breakage resistance. Conceivably, this is for the following reason: through employment of a relatively small value of the difference (θ1−θ2), in a region ranging from the shoulder portion to the fusion zone, the rate of change in cross-sectional area along the axial direction is relatively low; as a result, stress concentration on the shoulder portion and the fusion zone has been further restrained.

On the basis of the above test results, in view of further improvement of breakage resistance, preferably, the fusion zone, etc., are configured to satisfy the relational expression θ1−θ2≤50°.

Next, there were manufactured spark plug samples in which the tip length LC was set to 1.2 mm and θ1 was set to 45°, 60°, or 72° and which differed in the angle θ3 formed by the straight line L5 and the straight line L6 as effected through change in the configuration of the inner layer. The samples were subjected to a heating temperature measurement test. The outline of the heating temperature measurement test is as follows. Under the condition that in a conventional spark plug having a tip length of 0.4 mm, a distal end portion of the noble metal tip has a temperature of 1,000° C., forward end portions of the samples were heated by use of a predetermined burner, and the temperature of distal end portions of the noble metal tips was measured. The samples whose noble metal tips had a distal end portion temperature of 1,050° C. or less (that is, the samples whose temperature rise in heating above the temperature level of the conventional spark plug was suppressed to 50° C. or less) despite the condition that the noble metal tips were very likely to be heated because of a tip length LC of 1.2 mm were evaluated as "Good," indicating that they exhibited good heat transfer. The samples whose noble metal tips had a distal end portion temperature in excess of 1,050° C. were evaluated as "Fair," indicating that they are somewhat inferior in heat transfer. Table 2 shows the test results of the samples having an angle θ1 of 45°. Table 3 shows the test results of the samples having an angle θ1 of 60°. Table 4 shows the test results of the samples having an angle θ1 of 72°. Also, every sample had an outside diameter of 1.9 mm as measured at the proximal end of the body portion of the center electrode and an outside diameter of the noble metal tip of 0.7 mm. The shortest distance between the inner layer and the noble metal tip or the fusion zone was 2.0 mm or less.

Furthermore, there were manufactured spark plug samples which had a tip length LC of 1.2 mm and an angle θ1 of 45°, 60°, or 72° and differed in the shortest distance SD between the inner layer and the noble metal tip or the fusion zone. The samples were subjected to the above-mentioned heating temperature measurement test. The samples having an angle θ1 of 45° had an angle θ3 of 15°; the samples having an angle θ1 of 60° had an angle θ3 of 20°; and the samples having an angle θ1 of 72° had an angle θ3 of 25°. The center electrode, etc., were similar in size to those mentioned above. Table 5 shows the test results of the samples having an angle θ1 of 45°; Table 6 shows the test results of the samples having an angle θ1 of 60°; and Table 7 shows the test results of the samples having an angle θ1 of 72°.

TABLE 2

| θ1 | θ1 × ⅓ | θ3 | Distal end temp. | Evaluation |
|---|---|---|---|---|
| 45° | 15° | 5° | 1,077° C. | Fair |
| | | 10° | 1,065° C. | Fair |
| | | 15° | 1,042° C. | Good |
| | | 20° | 1,035° C. | Good |

TABLE 3

| θ1 | θ1 × ⅓ | θ3 | Distal end temp. | Evaluation |
|---|---|---|---|---|
| 60° | 20° | 10° | 1,083° C. | Fair |
| | | 15° | 10,72° C. | Fair |
| | | 20° | 1,040° C. | Good |
| | | 25° | 1,029° C. | Good |

TABLE 4

| θ1 | θ1 × ⅓ | θ3 | Distal end temp. | Evaluation |
|---|---|---|---|---|
| 72° | 24° | 15° | 1,075° C. | Fair |
| | | 20° | 1,061° C. | Fair |
| | | 25° | 1,037° C. | Good |
| | | 30° | 1,010° C. | Good |

TABLE 5

| θ1 | θ1 × ⅓ | θ3 | Shortest distance SD | Distal end temp. | Evaluation |
|---|---|---|---|---|---|
| 45° | 15° | 15° | 1.5 mm | 1,032° C. | Good |
| | | | 2.0 mm | 1,043° C. | Good |
| | | | 2.5 mm | 1,059° C. | Fair |
| | | | 3.0 mm | 1,061° C. | Fair |

TABLE 6

| θ1 | θ1 × ⅓ | θ3 | Shortest distance SD | Distal end temp. | Evaluation |
|---|---|---|---|---|---|
| 60° | 20° | 20° | 1.5 mm | 1,035° C. | Good |
| | | | 2.0 mm | 1,041° C. | Good |
| | | | 2.5 mm | 1,055° C. | Fair |
| | | | 3.0 mm | 1,062° C. | Fair |

TABLE 7

| θ1 | θ1 × ⅓ | θ3 | Shortest distance SD | Distal end temp. | Evaluation |
|---|---|---|---|---|---|
| 72° | 24° | 25° | 1.5 mm | 1,027° C. | Good |
| | | | 2.0 mm | 1,039° C. | Good |
| | | | 2.5 mm | 1,052° C. | Fair |
| | | | 3.0 mm | 1,060° C. | Fair |

As shown in Tables 2 to 4, the samples having an angle θ3 of less than (θ1×⅓) have been found somewhat inferior in heat transfer. Conceivably, this is for the following reason: since the volume of a forward end portion of the inner layer in the proximity of the noble metal tip is relatively small, efficient conduction of heat of the noble metal tip has failed.

Furthermore, as shown in Tables 5 to 7, the samples having a shortest distance SD in excess of 2.0 mm have been found somewhat inferior in heat transfer. Conceivably, this is for the following reason: since the inner layer is located away from the noble metal tip and from the fusion zone to a relatively large extent, heat of the noble metal tip has been less likely to be transmitted to the inner layer.

By contrast, the samples which have a shortest distance SD of 2.0 mm or less and which satisfy the relational expression (θ1×⅓)≤θ3 have been found to exhibit good heat transfer. Conceivably, this is for the following reason: the inner layer is sufficiently close to the noble metal tip, etc., and a forward end portion of the inner layer has a sufficient volume corresponding to the diametral size of a forward end portion of the center electrode, the diametral size varying with the angle θ1; thus, heat of the noble metal tip has been efficiently conducted.

On the basis of the above test results, for efficient transfer of heat of the noble metal tip, preferably, the shoulder portion and the inner layer are configured such that while the shortest distance SD is 2.0 mm or less, the relational expression (θ1×⅓)≤θ3 is satisfied.

Next, there were manufactured spark plug samples which had a tip length LC of 1.2 mm and an angle θ1 of 45°, 60°, or 72° and differed in the angle θ3, five pieces each of the angle θ3 values. The samples were subjected to a burner heating/cooling test. The outline of the burner heating/cooling test is as follows. The test conducted 2,500 cycles of heating/cooling, each cycle consisting of heating forward end portions of the center electrodes at a temperature of 1,000° C. for three minutes by use of a predetermined burner and subsequent gradual cooling for one minute. After completion of 2,500 cycles of heating/cooling, the center electrodes were observed for surface cracks. When all of five samples were free of cracking, the samples were evaluated as "Good," indicating that the samples have good expansion resistance. When at least one of five samples suffered from cracking, the samples were evaluated as "Fair," indicating that the samples are somewhat inferior in expansion resistance. Table 8 shows the test results of the samples having an angle θ1 of 45°; Table 9 shows the test results of the samples having an angle θ1 of 60°; and Table 10 shows the test results of the samples having an angle θ1 of 72°. Every sample had an outside diameter of 1.9 mm as measured at the proximal end of the body portion of the center electrode and an outside diameter of the noble metal tip of 0.7 mm. Also, the shortest distance between the inner layer and the noble metal tip or the fusion zone was 2.0 mm or less.

TABLE 8

| θ1 | θ1 × ¾ | θ3 | Evaluation |
|---|---|---|---|
| 45° | 33.75° | 21° | Good |
| | | 27° | Good |
| | | 33° | Good |
| | | 38° | Fair |

TABLE 9

| θ1 | θ1 × ¾ | θ3 | Evaluation |
|---|---|---|---|
| 60° | 45° | 40° | Good |
| | | 45° | Good |
| | | 50° | Fair |
| | | 55° | Fair |

TABLE 10

| θ1 | θ1 × ¾ | θ3 | Evaluation |
|---|---|---|---|
| 72° | 54° | 50° | Good |
| | | 55° | Fair |
| | | 60° | Fair |
| | | 65° | Fair |

As shown in Tables 8 to 10, the samples in which the angle θ3 is greater than (θ1×¾) have been found that cracking potentially arises in the center electrode in association with repeated heating/cooling cycles. Conceivably, this is for the following reason: since the diametral size of a forward end portion of the center electrode located in the vicinity of the noble metal tip varies with the angle θ1 (as θ1 reduces, the diametral size reduces, and as θ1 increases, the diametral size increases), due to employment of θ3 greater than (θ1×¾), as viewed on a section of a forward end portion of the center electrode taken orthogonally to the axis, the inner layer accounts for an excessively large area, whereas the outer layer is excessively thin-walled; as a result, the strength of the outer layer against thermal expansion of the inner layer has become insufficient.

By contrast, the samples in which the angle θ3 is equal to or less than (θ1×¾) have been found to have good expansion resistance. Conceivably, this is for the following reason: through employment of θ3 equal to or less than (θ1×¾), the inner layer has an appropriate volume corresponding to the diametral size of a forward end portion of the center electrode, the diametral size varying with the angle θ1, and the outer layer has an appropriate thickness; as a result, the outer layer has sufficient strength against thermal expansion of the inner layer.

On the basis of the above test results, in order to improve expansion resistance, preferably, the shoulder portion and the inner layer are configured to satisfy the relational expression θ3≤(θ1×¾).

The present invention is not limited to the above-described embodiment, but may be embodied, for example, as follows. Of course, applications and modifications other than those exemplified below are also possible.

Figure 8:
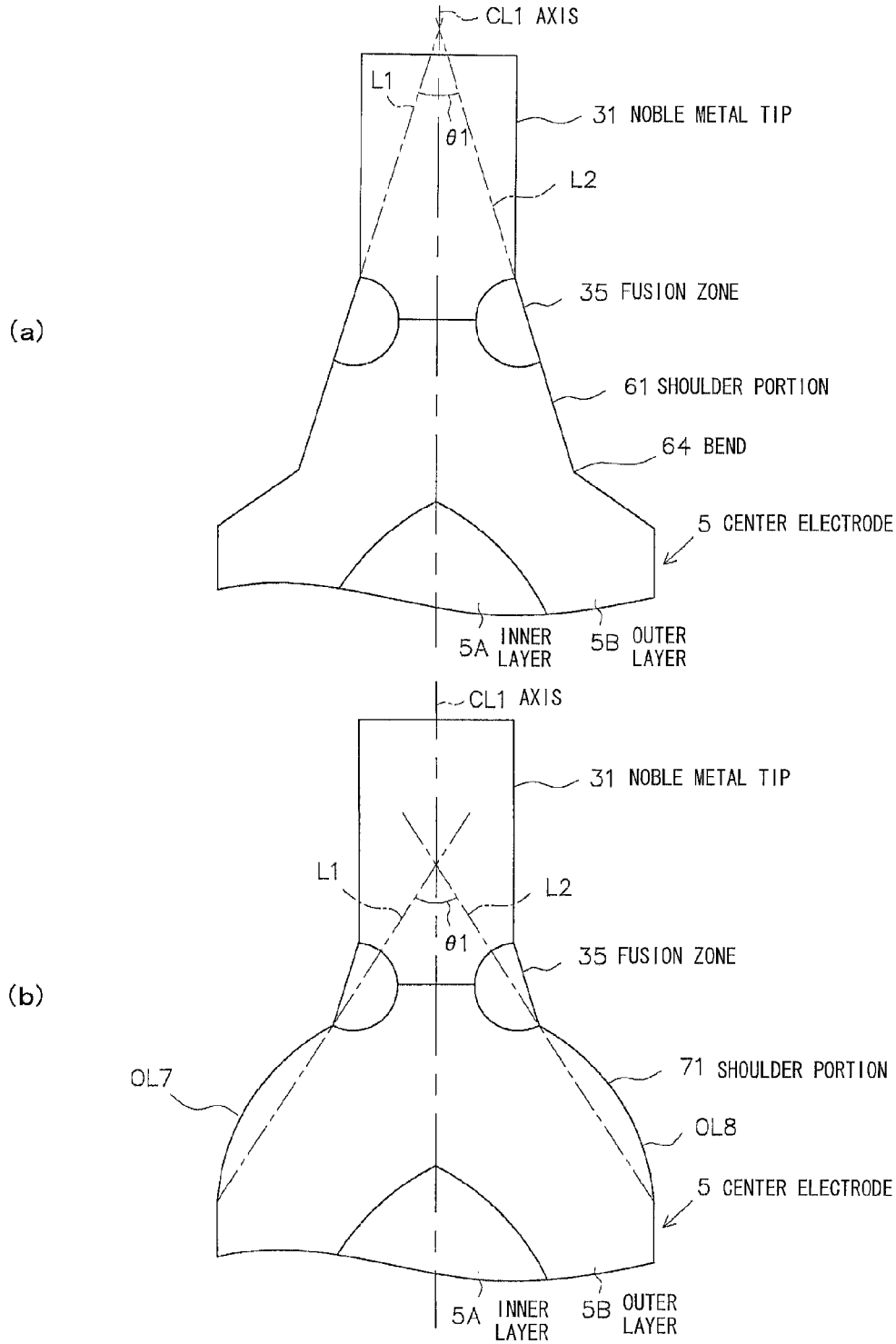
FIGS. 8(*a*) and 8(*b*) are enlarged schematic, fragmentary, sectional views showing the configuration of the shoulder portion, etc., in other embodiments.

(a) In the above-described embodiment, as viewed on the section which contains the axis CL1, the outlines OL1 and OL2 of the shoulder portion 51 are rectilinear. However, no particular limitation is imposed on the shape of the shoulder portion 51 so long as the shoulder portion 51 is tapered forward with respect to the direction of the axis CL1. For example, as shown in FIG. 8(*a*), a shoulder portion 61 may include a bend 64. Alternatively, as shown in FIG. 8(*b*), outlines OL7 and OL8 of a shoulder portion 71 may be slightly curved in such a manner as to assume an outwardly (or inwardly) convex shape (in FIGS. 8(*a*) and 8(*b*), hatching generally employed in a sectional view is omitted for convenience of explanation). In the case where the shoulder portion 61 includes the bend 64, each of the straight lines L1 and L2 is an extended straight line of a line segment located forward of the bend 64 in each of the outlines of the shoulder portion 61. In the case where the outlines OL7 and OL8 of the shoulder portion 71 are curved, each of the straight lines L1 and L2 is an axially forward extended straight line of a line segment that connects opposite ends of each of the outlines OL7 and OL8.

Figure 9:
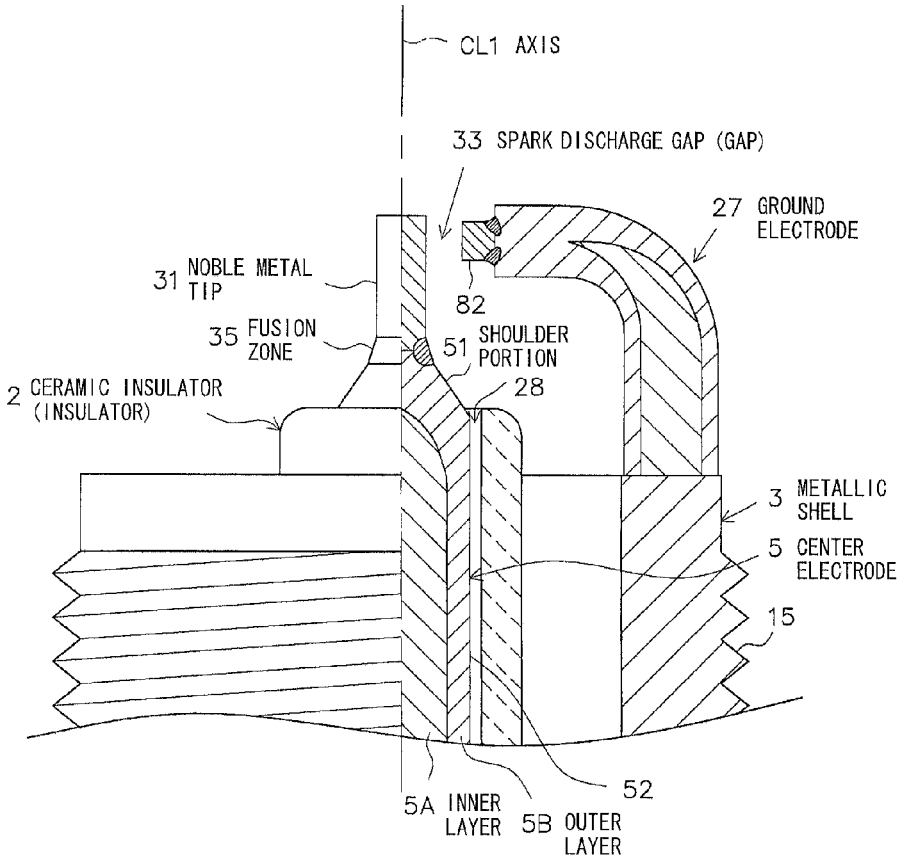
FIG. 9 is an enlarged partially cutaway front view showing the configuration of a spark plug of another embodiment.

(b) In the above-described embodiment, the noble metal member 32 is joined to a side surface of a distal end portion of the ground electrode 27. However, as shown in FIG. 9, a noble metal member 82 may be joined to the distal end surface of the ground electrode 27.

Figure 10:
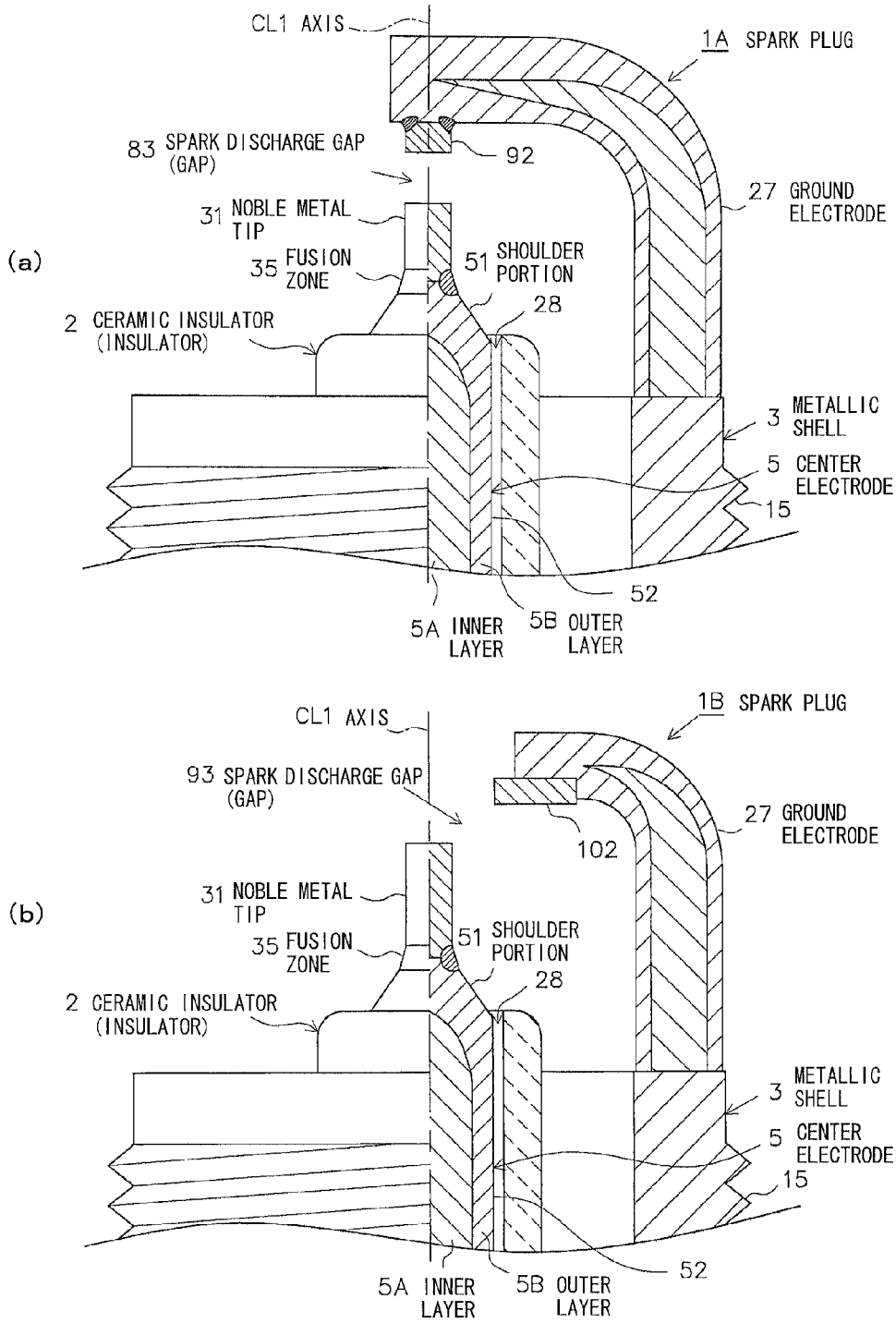
FIGS. 10(*a*) and 10(*b*) are enlarged partially cutaway front views showing the configurations of spark plugs of further embodiments.

(c) In the above-described embodiment, the technical concept of the present invention is applied to the spark plug 1 of such a type that spark discharge is performed substantially along a direction orthogonal to the axis CL1. However, a spark plug type to which the technical concept of the present invention is applicable is not limited thereto. For example, the technical concept of the present invention may be applied to a spark plug 1A of such a type that, as shown in FIG. 10(*a*), spark discharge is performed substantially along the direction of the axis CL1 across a spark discharge gap 83 formed between the noble metal tip 31 and a noble metal member 92, or to a spark plug 1B of such a type that, as shown in FIG. 10(*b*), spark discharge is performed substantially along a direction oblique to the axis CL1 across a spark discharge gap 93 formed between the noble metal tip 31 and a noble metal member 102. Even in this case, similar to the case of the above-described embodiment, ignition performance, etc., can be improved.

(d) In the above-described embodiment, the ground electrode 27 has the noble metal member 32. However, the noble metal member 32 may not be provided. In this case, the spark discharge gap 33 is formed between the noble metal tip 31 and the ground electrode 27.

(e) In the above-described embodiment, the center electrode 5 has a two-layer structure consisting of the inner layer 5A and the outer layer 5B. However, the center electrode 5 may have a multilayer structure, such as a three-layer structure, or a structure of four or more layers. Therefore, for example, the center electrode 5 may have a structure in which an intermediate layer of a copper alloy or pure copper is provided internally of the outer layer 5B, and an innermost layer of pure nickel is provided internally of the intermediate layer. In the case where the center electrode 5 has a structure of three or more layers, a plurality of layers located internally of the outer layer 5B and containing a metal higher in thermal conductivity than the outer layer 5B correspond collectively to the inner layer 5A. For example, in the case of employment of the above-mentioned structure including the intermediate layer and the innermost layer, the intermediate layer and the innermost layer correspond collectively to the inner layer 5A.

(f) In the above-described embodiment, the ground electrode 27 is joined to the forward end portion of the metallic shell 3. However, the present invention is also applicable to the case where a portion of a metallic shell (or a portion of an end metal welded beforehand to the metallic shell) is cut to form a ground electrode (refer to, for example, Japanese Patent Application Laid-Open (kokai) No. 2006-236906).

(g) In the above-described embodiment, the tool engagement portion 19 has a hexagonal cross section. However, the shape of the tool engagement portion 19 is not limited thereto. For example, the tool engagement portion 19 may have a Bi-HEX (modified dodecagonal) shape [IS022977:2005(E)] or the like.

DESCRIPTION OF REFERENCE NUMERALS

1: spark plug
2: ceramic insulator (insulator)
3: metallic shell
4: axial bore
5: center electrode
5A: inner layer
5B: outer layer
27: ground electrode
31: noble metal tip
33: spark discharge gap (gap)
35: weld zone
51: shoulder portion
CL1: axis

The invention claimed is:

1. A spark plug comprising:

a tubular insulator having an axial bore extending through the insulator in a direction of an axis;

a center electrode inserted into a forward end portion of the axial bore;

a tubular metallic shell provided externally of an outer circumference of the insulator;

a ground electrode disposed at a forward end portion of the metallic shell; and a noble metal tip joined to a forward end portion of the center electrode, a gap being formed between said metal tip and the ground electrode;

wherein the center electrode has a shoulder portion at a forward end portion of the center electrode, the shoulder portion tapering forward with respect to the direction of the axis;

the noble metal tip is jointed to the center electrode via a fusion zone provided at least partially at a rear end portion of the noble metal tip; and a shortest distance between the fusion zone and a forward end surface of the noble metal tip is 0.8 mm to 1.2 mm inclusive as measured on an outer side surface of the noble metal tip along the axis, wherein;

an outside diameter of the fusion zone as measured at a forward end of the fusion zone is smaller than that as measured at a rear end of the fusion zone, and relational expressions $\theta 1 > \theta 2$ and $(\theta 1 - \theta 2) \leq 50°$ are satisfied, where $\theta 1$ is an acute angle formed by a straight line L1 and a straight line L2 defined below, satisfying a relational expression $\theta 1 \leq 72°$, and $\theta 2$ is an acute angle formed by a straight line L3 and a straight line L4 defined below, as viewed on a section which contains the axis and on which $\theta 2$ is maximized, where the straight line L1 is, as viewed on a section which contains the axis, an axially forwardly extended straight line of one of two outlines of the shoulder portion, the two outlines being located on opposite sides with respect to the axis, the straight line L2 is, as viewed on the section which contains the axis, an axially forwardly extended straight line of the other of the two outlines of the shoulder portion, the two outlines being located on opposite sides with respect to the axis, the straight line L3 is, as viewed on the section which contains the axis, a straight line which passes through opposite ends of one of two outlines formed on an externally exposed surface of the fusion zone, the one outline being located on one side with respect to the axis, and the straight line L4 is, as viewed on the section which contains the axis, a straight line which passes through opposite ends of the other of the two outlines formed on an externally exposed surface of the fusion zone, the other outline being located on the other side with respect to the axis.

2. A spark plug according to claim 1, wherein as viewed on the section which contains the axis, the outlines of the shoulder portion are rectilinear.

3. A spark plug according to claim 1, wherein:

the center electrode comprises an outer layer and an inner layer, said inner layer being provided within the outer layer and being higher in thermal conductivity than the outer layer;

a distance from the inner layer to a rear end surface of the noble metal tip or a distance from the inner layer to the fusion zone, whichever is shorter, is 2 mm or less; and with θ3 representing, as viewed on the section which contains the axis, an acute angle formed by two straight lines which pass through an intersection point of the straight lines L1 and L2 and which are tangent to an outline of the inner layer, a relational expression $(\theta 1 \times 1/3) \leq \theta 3$ is satisfied.

4. A spark plug according to claim 3, wherein a relational expression $\theta 3 \leq (\theta 1 \times 3/4)$ is satisfied.

5. A spark plug according to claim 1, wherein the ground electrode is disposed in such a manner that a forward end surface of the ground electrode faces an outer side surface of the noble metal tip, and spark discharge is performed across the gap substantially along a direction orthogonal to the axis.

6. A spark plug according to claim 1, wherein the noble metal tip assumes the form of a circular column, and a forward end surface of the noble metal tip has an outside diameter of 0.7 mm or less.

7. A spark plug according to claim 1, wherein the noble metal tip assumes the form of a circular column, and a forward end surface of the noble metal tip has an outside diameter of 0.5 mm or less.

8. A spark plug according to claim 1, wherein the noble metal tip is formed of an alloy which contains iridium or platinum as a main component.

9. A spark plug comprising:

a tubular insulator having an axial bore extending through the insulator in a direction of an axis;

a center electrode inserted into a forward end portion of the axial bore;

a tubular metallic shell provided externally of an outer circumference of the insulator;

a ground electrode disposed at a forward end portion of the metallic shell; and a noble metal tip joined to a forward end portion of the center electrode, a gap being formed between said metal tip and the ground electrode;

wherein the center electrode having a shoulder portion at a forward end portion of the center electrode, the shoulder portion tapering forward with respect to the direction of the axis, the noble metal tip is jointed to the center electrode via a fusion zone provided at least partially at a rear end portion of the noble metal tip, and a shortest distance between the fusion zone and a forward end surface of the noble metal tip is 0.8 mm to 1.2 mm inclusive as measured on an outer side surface of the noble metal tip along the axis, wherein;

an outside diameter of the fusion zone as measured at a forward end of the fusion zone is smaller than that as measured at a rear end of the fusion zone, an acute angle θ1 formed by a straight line L1 and a straight line L2 defined below satisfying a relational expression $\theta 1 \leq 72°$, the center electrode comprises an outer layer and an inner layer, said inner layer being provided within the outer layer and higher in thermal conductivity than the outer layer, a distance from the inner layer to a rear end surface of the noble metal tip or a distance from the inner layer to the fusion zone, whichever is shorter, is 2 mm or less, and an acute angle θ3 formed by two straight lines which pass through an intersection point of the straight lines L1 and L2 as viewed on the section which contains the axis and which are tangent to an outline of the inner layer, and satisfying a relational expression $(\theta 1 \times 1/3) \leq \theta 3$, wherein the straight line L1 is, as viewed on a section which contains the axis, an axially forwardly extended straight line of one of two outlines of the shoulder portion, the two outlines being located on opposite sides with respect to the axis, and the straight line L2 is, as viewed on the section which contains the axis, an axially forwardly extended straight line of the other of the two outlines of the shoulder portion, the two outlines being located on opposite sides with respect to the axis.

10. A spark plug according to claim 9, wherein as viewed on the section which contains the axis, the outlines of the shoulder portion are rectilinear.

11. A spark plug according to claim 9, wherein:

the center electrode comprises an outer layer and an inner layer, said inner layer being provided within the outer layer and being higher in thermal conductivity than the outer layer;

a distance from the inner layer to a rear end surface of the noble metal tip or a distance from the inner layer to the fusion zone, whichever is shorter, is 2 mm or less; and with θ3 representing, as viewed on the section which contains the axis, an acute angle formed by two straight lines which pass through an intersection point of the straight lines L1 and L2 and which are tangent to an outline of the inner layer, a relational expression $(\theta 1 \times 1/3) \leq \theta 3$ is satisfied.

12. A spark plug according to claim 9, wherein a relational expression $\theta 3 \leq (\theta 1 \times 3/4)$ is satisfied.

13. A spark plug according to claim 9, wherein the ground electrode is disposed in such a manner that a forward end surface of the ground electrode faces an outer side surface of the noble metal tip, and spark discharge is performed across the gap substantially along a direction orthogonal to the axis.

14. A spark plug according to claim 9, wherein the noble metal tip assumes the form of a circular column, and a forward end surface of the noble metal tip has an outside diameter of 0.7 mm or less.

15. A spark plug according to claim 9, wherein the noble metal tip assumes the form of a circular column, and a forward end surface of the noble metal tip has an outside diameter of 0.5 mm or less.

16. A spark plug according to claim 9, wherein the noble metal tip is formed of an alloy which contains iridium or platinum as a main component.

* * * * *